US007542578B2

(12) United States Patent
Akino

(10) Patent No.: US 7,542,578 B2
(45) Date of Patent: Jun. 2, 2009

(54) CONDENSER MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 981 days.

(21) Appl. No.: 11/127,197

(22) Filed: May 12, 2005

(65) Prior Publication Data

US 2005/0254671 A1 Nov. 17, 2005

(30) Foreign Application Priority Data

May 14, 2004 (JP) ..... 2004-144841

(51) Int. Cl.
*H04R 3/00* (2006.01)

(52) U.S. Cl. ..... 381/113; 381/111; 381/120; 381/375

(58) Field of Classification Search ..... 381/111–115, 381/122, 174, 375
See application file for complete search history.

(56) References Cited

U.S. PATENT DOCUMENTS 4,211,893 A * 7/1980 Smith ..... 381/118
5,459,792 A * 10/1995 Reichel et al. ..... 381/111
6,285,769 B1 * 9/2001 Edelson et al. ..... 381/95
7,046,815 B2 * 5/2006 Akino et al. ..... 381/122
7,295,675 B2 * 11/2007 Akino et al. ..... 381/113

* cited by examiner

*Primary Examiner*—Vivian Chin
*Assistant Examiner*—Disler Paul
(74) *Attorney, Agent, or Firm*—Manabu Kanesaka

(57) ABSTRACT

The DC magnetization of a transformer core is prevented without increasing the size of an output transformer in a condenser microphone which is operated by a phantom power source, uses a vacuum tube as an impedance converter, and outputs a vacuum tube signal via the output transformer. The condenser microphone includes a condenser microphone capsule MC, a vacuum tube V01 used as an impedance converter, and an output transformer TRS having a primary winding F connected to the plate and screen grid of the vacuum tube V01 and a secondary winding S connected to the phantom power source via an output connector, wherein the primary winding F has a center tap CF and both ends of the secondary winding S are connected to the center tap CF via constant current diodes D04 and D05, respectively.

2 Claims, 2 Drawing Sheets

CONDENSER MICROPHONE

RELATED APPLICATIONS

The present application is based on, and claims priority from, Japanese Application No. 2004-144841, filed May 14, 2004, the disclosure of which is hereby incorporated by reference herein in its entirety.

TECHNICAL FIELD

The present invention relates to a condenser microphone operated by a phantom power source, and more specifically to a condenser microphone using a vacuum tube as an impedance converter.

BACKGROUND ART

In a condenser microphone, an FET (field-effect transistor) or a vacuum tube is used as an impedance converter. This is because a condenser microphone capsule including a diaphragm and a fixed pole opposed to each other has quite a high impedance.

When a vacuum tube is used as the impedance converter of a condenser microphone, generally a dedicated power source is necessary. Further, "A" power source for heating the heater of the vacuum tube and "B" power source for passing current through the plate of the vacuum tube are necessary to operate the vacuum tube.

In general, a vacuum tube used as an impedance converter requires "A" power source of about 6.3 V and 0.35 A and "B" power source of about 120 V and 10 mA. Thus, a typical phantom power source of DC 48 V cannot afford such a power and thus a dedicated power source is used.

Incidentally, there is a vacuum tube which has low consumption and operated by batteries (e.g., a directly heated pentode, model 6418, Raytheon, US). This vacuum tube with low power consumption is developed exclusively for hearing aids and has "A" power source operating at 1.25 V and 10 mA and "B" power source operating at 30V and 0.24 mA.

The vacuum tube operating at such a voltage can be sufficiently operated by the phantom power source of DC 48 V. However, when the "A" power source (1.25 V, 10 mA) is stabilized as it is by a Zener diode or the like, a current of 10 mA passes through the heater of the vacuum tube, and thus a voltage supplied from the phantom power source decreases.

For example, when a current of 10 mA passes through the heater of the vacuum tube, a voltage supplied from the phantom power source to a microphone is reduced by 34 V (5 mA×6.8 kΩ) to 14 V. In this state, the "B" power source is insufficiently supplied to the plate of the vacuum tube, and thus this state interferes with the operations of the vacuum tube.

In order to enable a microphone using a vacuum tube as an impedance converter to be operated by a phantom power source, the present applicant applied Japanese Patent Application No. 2003-6621 (Japanese Patent Application Publication No. 2004-221919) before. In this invention, "A" power source for heating the heater of a vacuum tube is obtained from a phantom power source by using a down converter which causes little noise and is readily available.

The configuration of the condenser microphone according to the invention of the prior application will be schematically described with reference to the circuit diagram of FIG. 2. The microphone comprises a vacuum tube V01 as an impedance converter of a condenser microphone capsule MC. For example, the vacuum tube V01 is a directly heated pentode, model 6418, Raytheon, US.

In the vacuum tube V01, "A" power source operates at 1.25 V and 10 mA and "B" power source operates at 30 V and 0.24 mA. Reference numeral R01 denotes a bias resistor of the control grid of the vacuum tube V01, and reference numeral C01 denotes a feedback condenser from the plate to the control grid of the vacuum tube V01.

The plate of the vacuum tube V01 is connected to one end of the primary winding of an output transformer TRS, and the screen grid of the vacuum tube V01 is connected to the other end of the primary winding of the output transformer TRS via a voltage divider circuit including voltage divider resistors R02 and R03. The secondary winding of the output transformer TRS is connected to an output connector CN.

The output connector CN is, e.g., a 3-pin output connector defined by EIAJ RC5236. The output connector CN includes a terminal H connected to the hot side of a phantom power source (not shown), a terminal C connected to the cold side of the phantom power source, and a terminal G connected to the ground side of the phantom power source. The secondary winding of the output transformer TRS is connected to the terminal H and the terminal C. The ground side of the microphone capsule MC and the ground pole of the heater of the vacuum tube V01 or the like are connected to the terminal G.

The invention of the prior application comprises an "A" power source generating circuit 10 for obtaining "A" power source for the vacuum tube V01 from the phantom power source. The "A" power source generating circuit 10 includes at least one switched capacitor voltage converter IC and is connected to the heater of the vacuum tube V01. In the example of FIG. 2, three converters IC01, IC02, and IC03 (LM2665, National Semiconductor, US) are connected in series in three stages.

The converter IC, LM2665, has six pins. When a positive voltage is inputted from a first pin, the converter IC acts as a dual boost converter in which a doubled voltage is outputted from a fifth pin. Conversely, when a positive voltage is inputted from the fifth pin, the converter IC acts as a ½ step-down converter in which a half voltage is outputted from the first pin.

In the invention of the prior application, the converters IC01 to IC03 are used as ½ step-down converters. Thus, a positive voltage is inputted from the fifth pin and a half output voltage is obtained from the first pin in each of the converters IC01 to IC03. A second pin acts as a ground pin and a fourth pin acts as a shut-down control pin. Charge pump condensers C06, C08, and C10 are connected between third pins and sixth pins of the condensers IC01, IC02, and IC03, respectively. Condensers C05, C07, and C09 for smoothing and AC grounding are connected to the first pins of the output sides of the condensers IC01, IC02, and IC03, respectively.

The "A" power source generating circuit 10 comprises an input circuit 10*a* composed of a series circuit of a current limiting resistor R04 and a Zener diode D01, and constant current diodes D02 and D03 for drawing, through the input circuit 10*a*, a predetermined current supplied from the phantom power source through the terminals H and C.

For example, 30 V and 1.5 mA are supplied from the constant current diodes D02 and D03 to the input circuit 10*a*, an input voltage to the "A" power source generating circuit 10 is set to 10 V by the Zener diode D01 in the input circuit 10*a*, and an input current to the "A" power source generating circuit 10 is limited to 1.25 mA by the current limiting resistor R04.

Hence, in the converter IC03 of the first stage, the converter IC02 of the second stage, and the converter IC01 of the third stage, a voltage is sequentially changed to 5 V, 2.5 V, and 1.25 V and a current is sequentially changed to 2.5 mA, 5.0 mA, and 10 mA. In the end, the "A" power supply of 1.25 V and 10 mA is supplied from the converter IC01 of the third stage to the heater of the vacuum tube V01. In FIG. 2, reference numerals C02, C03, C04, and C11 denote smoothing condensers.

As described above, about 1.25 mA is enough as a current drawn from the phantom power source to the "A" power source generating circuit 10, and thus about 4.25 V is enough as a voltage drop for heating the heater. Hence, it is possible to sufficiently obtain "B" power source for applying current to the plate of the vacuum tube V01.

According to the invention of the prior application, although the condenser microphone having the vacuum tube used as the impedance converter can be operated by the phantom power source, a power source voltage is low and thus the "B" power source has an amplifier circuit configuration, in which the primary side of the output transformer TRS is connected to the plate of the vacuum tube V01.

Therefore, DC current to be supplied to the plate of the vacuum tube V01 passes through the primary side of the output transformer TRS, so that the core of the transformer is DC magnetized. When the DC magnetization increases, the core is magnetically saturated and the performance of the transformer considerably decreases. Thus, at worst, a voice signal may not be transmitted from the primary side to the secondary side.

As a method for preventing DC magnetization of a transformer core, the following methods are known: a method of increasing the size of a core; a method of using a material of low magnetic permeability for a core; and a method of positively forming a gap between cores so as to have magnetic leakage on the connection of the cores. In any case, the dimensions of the transformer increase and the performance undeniably decreases as compared with a transformer designed so as not to pass current.

SUMMARY OF THE INVENTION

Therefore, it is an object of the present invention to prevent the DC magnetization of a transformer core without increasing the size of an output transformer in a condenser microphone which uses a vacuum tube as an impedance converter, outputs a vacuum tube signal via the output transformer, and is operated by a phantom power source.

In order to attain the object, the present invention includes a condenser microphone capsule, a vacuum tube used as an impedance converter, and an output transformer having a primary winding connected to the plate and screen grid of the vacuum tube and a secondary winding connected to a phantom power source via an output connector. In a condenser microphone operated by the phantom power source, the primary winding has a center tap and both ends of the secondary winding are connected to the center tap via constant current diodes, respectively.

In the present invention, a voltage divider resistor for applying a predetermined voltage to the screen grid is connected to the screen grid. It is preferable that a relative difference between a current supplied from one end of the primary winding to the plate and a current supplied from the other end of the primary winding to the voltage divider resistor be 5% or less.

According to the present invention, current supplied from the phantom power source, which is an external power source, is partly supplied from both ends of the secondary winding of the output transformer to the center tap of the primary winding via the constant current diodes, and the current is supplied from the center tap to the plate and screen grid of the vacuum tube, so that the DC magnetization of the transformer core is cancelled out.

In this case, since a relative difference between a current supplied to the plate and a current supplied to the screen grid is reduced to 5% or less, the transformer core is not magnetically saturated. Further, the constant current diodes are connected between the center tap and the secondary winding, and thus a voice signal outputted from the vacuum tube does not bypass the output transformer.

DETAILED DESCRIPTION

Figure 1:
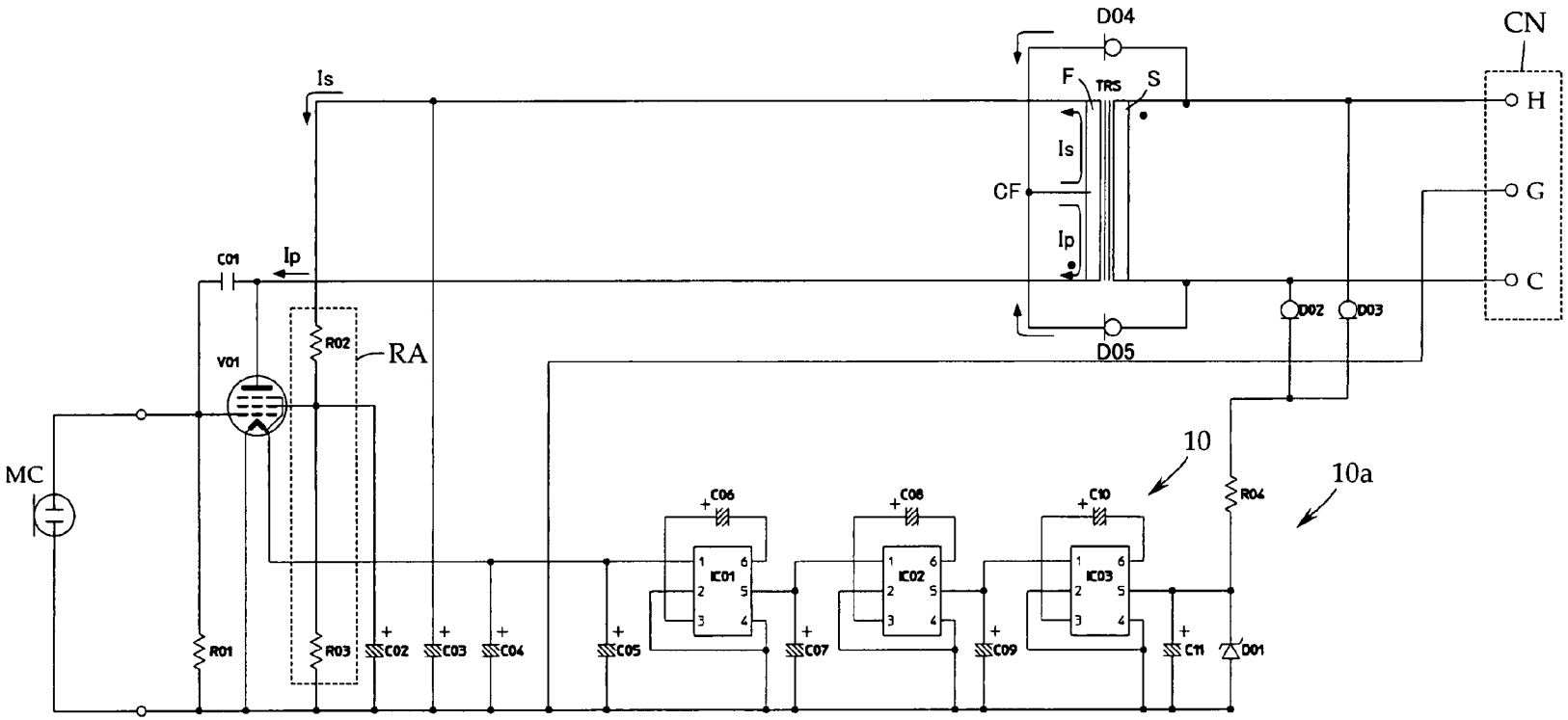
FIG. 1 is a circuit diagram showing an example of a condenser microphone according to the present invention.
Figure 2:
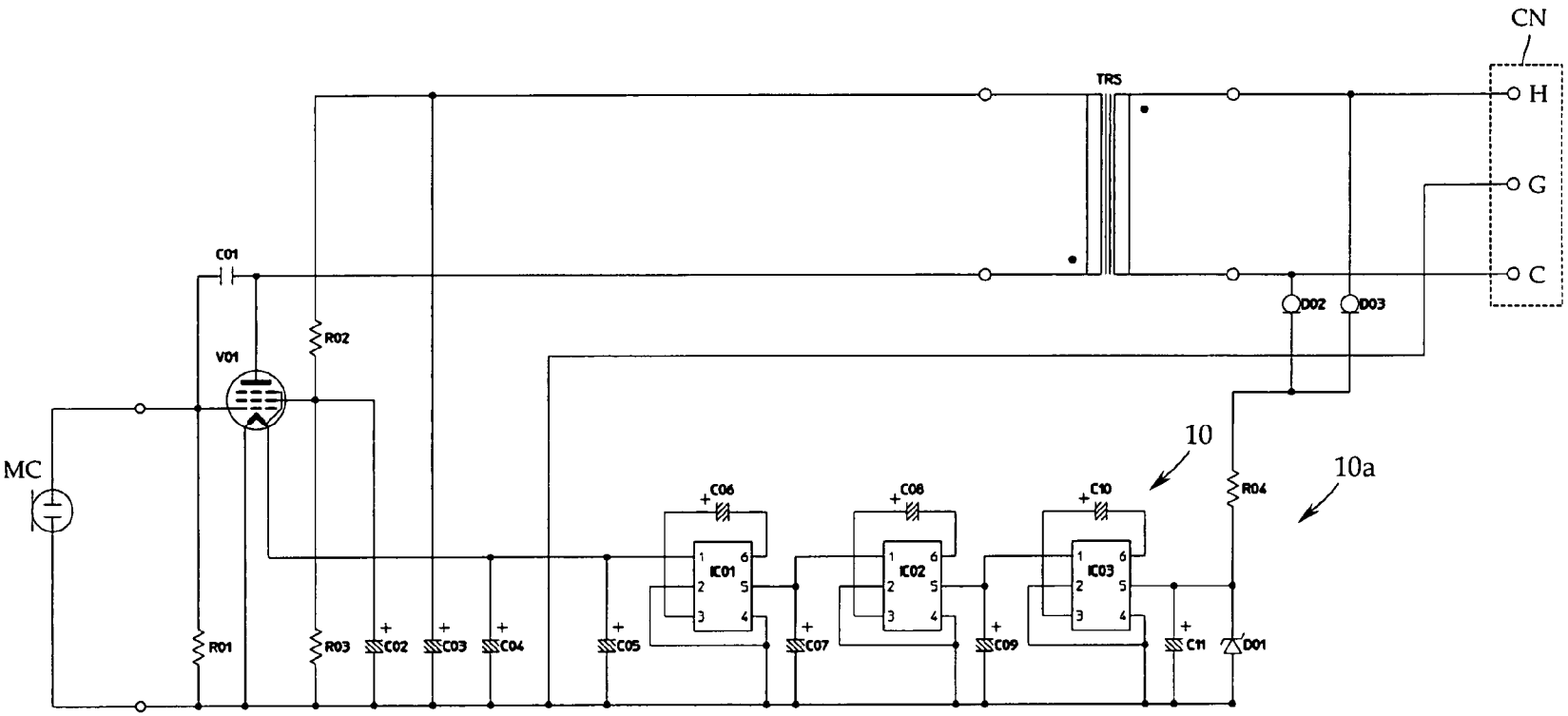
PRIOR ART FIG. 2
FIG. 2 is a circuit diagram showing a condenser microphone of the conventional art (the invention of the prior application).

The following will describe an embodiment of the present invention with reference to FIG. 1, a circuit diagram of a microphone. The present invention is not limited to this embodiment. In the explanation of this embodiment, constituent elements particularly not to be changed from the invention of the prior application of FIG. 2 are indicated by the same reference numerals.

The condenser microphone of the present invention is operated by a phantom power source. The phantom power source is not shown because it is a publicly known power source having two 6.8-kΩ resistors connected in series between hot and cold of balanced transmission and a power source of DC 48 V connected between the ground and the joint of the resistors.

As shown in FIG. 1, the condenser microphone of the present invention is basically constituted of a condenser microphone capsule MC, a vacuum tube V01 serving as an impedance converter, an output transformer TRS, an output connector CN, and an "A" power source generating circuit 10 for obtaining "A" power source (power source for heating a heater) for the vacuum tube V01 from the phantom power source.

The main part of the present invention is the output transformer TRS. The condenser microphone capsule MC, the output connector CN, and the "A" power source generating circuit 10 can be similar to those of the invention of the prior application, and thus the explanation thereof is omitted. In the circuit of FIG. 1, wiring from constant current diodes D02 and D03 to a smoothing condenser C03 is eliminated.

In the present invention, the "A" power source generating circuit does not always have to be constituted of a switched capacitor voltage converter IC. For example, a down-converter of pulse width modulation such as Low-Voltage, Step-Down DC-DC converter MAX1733, Maxim Integrated Products, US may be used.

One end of a primary winding F of the output transformer TRS is connected to the plate of the vacuum tube V01, and the other end of the primary winding F is connected to a voltage divider circuit RA including voltage divider resistors R02 and R03 for applying a voltage to the screen grid (second grid) of the vacuum tube V01. One end of a secondary winding S of the output transformer TRS is connected to a terminal H of the output connector CN, and the other end of the secondary winding S is connected to a terminal C of the output connector CN.

According to the present invention, a center tap CF is drawn from the primary winding F of the output transformer TRS. The center tap CF is connected to one end of the secondary winding S via a constant current diode D04. The center tap CF is also connected to the other end of the secondary winding S via a constant current diode D05.

The constant current diodes D04 and D05 are connected in the backward direction when viewed from the center tap CF, and are connected in the forward direction when viewed from the secondary winding S. The constant current diodes D04 and D05 have the same specifications. In this example, the diodes D04 and D05 both have a rated current of 0.5 mA. Therefore, a current of 0.5 mA is supplied from the terminal H and the terminal C of the secondary winding S to the center tap CF.

Thus, a current of 1.0 mA is supplied from the secondary winding S to the center tap CF. The current is divided into two, and one current Ip (0.5 mA) passes to one end of the primary winding F from the center tap CF and is supplied to the plate of the vacuum tube V01. The other current Is (0.5 mA) passes to the other end of the primary winding F from the center tap CF and is supplied to the voltage divider circuit RA.

In this way, the current Ip and the current Is pass from the center tap CF to the primary winding F in opposite directions, so that the DC magnetization of a core is cancelled out. Further, the constant current diodes D04 and D05 connected in the backward direction are present between the center tap CF and the secondary winding S, and thus a voice signal outputted from the vacuum tube V01 is amplified with a turn ratio of the output transformer TRS and outputted without bypassing the output transformer TRS.

Ideally, the current Ip and the current Is should have equal current values to cancel out the DC magnetization of the core. When a relative difference between the current values of the current Ip and the current Is is 5% or less, it is possible to substantially prevent the DC magnetization of the core.

As described above, according to the present invention, it is possible to eliminate the need for a large and special transformer for preventing the DC magnetization of the core. An ordinary small signal transformer having a center tap on its primary side can be used as it is. Incidentally, as compared with EI-35 (dimensions: 35×30×27 mm, weight: 93.8 g) which is a special transformer for preventing DC magnetization, the transformer can be reduced in volume by about one seventh and reduced in weight by one eighth.

The invention claimed is

1. A condenser microphone, comprising:

a condenser microphone capsule, a vacuum tube used as an impedance converter, and an output transformer having a primary winding connected to a plate and a screen grid of the vacuum tube and a secondary winding connected to a phantom power source via an output connector, the condenser microphone being operated by the phantom power source, wherein the primary winding has a center tap and both ends of the secondary winding are connected to the center tap via constant current diodes, respectively.

2. The condenser microphone according to claim 1, further comprising a voltage divider resistor connected to the screen grid to apply a predetermined voltage to the screen grid, wherein a relative difference between a current supplied from one end of the primary winding to the plate and a current supplied from the other end of the primary winding to the voltage divider resistor is 5% or less.

* * * * *